US006273970B1

(12) United States Patent
Kopeliovich et al.

(10) Patent No.: US 6,273,970 B1
(45) Date of Patent: Aug. 14, 2001

(54) ALUMINUM-BISMUTH BEARING ALLOY AND METHODS FOR ITS CONTINUOUS CASTING

(75) Inventors: Dmitri Kopeliovich; Alexander Shapiro, both of Beer-Sheva; Vladimir Shagal, Tel-Aviv, all of (IL)

(73) Assignee: Elecmatec Electro-Magnetic Technologies, Ltd., Omer (IL)

( * ) Notice: Subject to any disclaimer, the term of this patent is extended or adjusted under 35 U.S.C. 154(b) by 0 days.

(21) Appl. No.: 09/255,394

(22) Filed: Feb. 22, 1999

(30) Foreign Application Priority Data

Mar. 1, 1998 (IL) ..... 123503

(51) Int. Cl.[7] ..... C22C 21/00
(52) U.S. Cl. ..... 148/437; 420/548; 420/554
(58) Field of Search ..... 420/548, 554; 148/437, 440

(56) References Cited

U.S. PATENT DOCUMENTS

| | | | | |
|---|---|---|---|---|
| 4,590,133 | | 5/1986 | Lloyd | 428/653 |
| 5,192,377 | * | 3/1993 | Prinz et al. | 148/437 |
| 5,268,455 | * | 12/1993 | Kamiya | 420/554 |
| 5,286,455 | | 2/1994 | Eilers et al. | 422/110 |
| 5,585,067 | * | 12/1996 | Leroy et al. | 420/554 |

* cited by examiner

*Primary Examiner*—George Wyszomierski
(74) *Attorney, Agent, or Firm*—Stroock & Stroock & Lavan LLP

(57) ABSTRACT

The invention provides an aluminum alloy having a homogenous distribution of bismuth therein comprising at least 5 wt/wt % bismuth, wherein about 3.5 wt/wt % of the bismuth is distributed in the form of very small particles of up to 5 microns diameter and at least 2 wt/wt % of the bismuth is distributed in the form of spherical particles of about 10 to 40 microns in diameter and the very small particles and the spherical particles are homogenously distributed throughout the aluminum matrix.

3 Claims, 4 Drawing Sheets

$$\vec{F}^{g}_{Al} + \vec{F}^{e}_{Al} = \vec{F}^{e}_{Bi} + \vec{F}^{g}_{Bi}$$

B - magnetic field

J - electric current density $F^g$- gravitation force $F^e$- electromagnetic force

ALUMINUM-BISMUTH BEARING ALLOY AND METHODS FOR ITS CONTINUOUS CASTING

The present invention relates to an aluminum alloy having therein a homogenous distribution of bismuth, and to methods for its continuous casting.

A typical slide bearing alloy consists of three main materials: a relatively hard matrix material (aluminum or copper), a combination of soft components for providing self-lubricating properties to bearings, and small quantities of various additives which modify the structure and properties of the matrix metal.

The most common Al-based engine bearing alloys comprise 6–20% of tin as a soft component. Al—Sn alloys may be produced by conventional casting methods; however, the lubricating properties of Sn are low, as compared to materials such as Pb and Bi.

An additional problem with aluminum-tin alloys is that tin forms continuous net surrounding matrix grains in Al—Sn alloys, causing these alloys to have a relatively low fatigue resistance.

Aluminum base alloy bearings containing lead as a soft component, are of a higher quality than Al—Sn bearings. Higher seizure resistance is achieved in Al—Pb bearings at 2–3 times that of lower soft phase contents. In addition, lead is dispersed throughout the aluminum matrix in the form of separate spherical particles. These properties enhance the fatigue resistance of engine bearings containing lead.

Despite the evident advantages of aluminum-lead bearings, this alloy is not widely used because of two main manufacturing problems: (1) the low miscibility of lead in liquid aluminum; and (2) the large difference between the densities of the two metals. These problems result in the gravitational segregation of heavy lead droplets during the cooling down and solidification of the Al—Pb alloy. Therefore, conventional casting methods do not enable the manufacture of a homogeneous aluminum matrix containing lead particles.

Metallurgical problems of the Al—Pb alloy also relate to another aluminum base system, Al—Bi. Bi also has limited miscibility in liquid aluminum. Furthermore, the density of liquid Bi is four times higher than that of liquid aluminum. Therefore, conventional casting of Al—Bi alloy causes gravitational segregation of the heavier phase Bi in the bottom region of the casting.

In contrast to lead, bismuth is an environmentally friendly metal. Because bismuth possesses most of the properties of lead, including self-lubrication, several attempts to make aluminum-bismuth engine bearing alloys have been made.

An aluminum base alloy, containing bismuth in a quantity of 4.25–7 wt. %, was proposed in U.S. Pat. 4,590,133. The aluminum-bismuth alloys of said Patent were demonstrated to have excellent anti-seizure properties. In order to impart wear to the alloy, 2–2.5% Si was added, and 1.25–2.3% lead was added to enhance surface property. Small additions of about 1% Cu were made to increase the strength of the Al—Bi material. The addition of a number of other additives was proposed, such as nickel, manganese, chromium, tin, antimony and zinc.

It is noted in said Patent that there are practical limitations to the amount of bismuth which can be accommodated in an aluminum alloy produced by a casting process, because of the liquid immiscibility of aluminum and bismuth. This was probably the reason why a relatively low, maximum Bi content of 7% was described therein.

Test results presented in said Patent demonstrate the superiority of Al—Bi alloys to aluminum-tin alloy. However, some of the results are contradictory; this contradiction may be attributed to non-uniform distribution of Bi particles in the aluminum matrix. A typical example of the inconsistent results reported in said Patent is found with regard to the description therein of an alloy containing only 3% of Bi and 4.3% of Si. The tensile strength of this alloy, presented in said Patent, is 16,419 psi. Such a low value of tensile strength of Al—Si alloy (lower than that of Al-20% Sn) must be assumed to be caused by very bad bismuth distribution (large Bi particles and gravitational segregation of bismuth). This example shows the importance of both a proper metallurgical structure of Al—Bi alloy for engine slide bearings and a method of casting which enables producing such a structure.

U.S. Pat. No. 5,286,445 teaches an Al—Bi alloy having different additives, including Zr, which precipitates during thermal treatment after rolling operations and causes the division of stretched-out Bi particles. This method achieved fine bismuth inclusions, but is not able to prevent the gravitational segregation of Bi. In addition, the method does not control the size of Bi particles formed during solidification. This may cause the formation of a coarse Bi cast structure, resulting in long Bi ribbons which divide into fine grains during subsequent annealing operations. However, these fine inclusions form long chains, which considerably decrease the fatigue resistance of the bearing.

Bi has also been proposed as an auxiliary supplement for improving the seizure resistance quality of alloys, but the quantity of Bi is either relatively low (~2%), e.g., as described in U.S. Pat. No. 5,122,208, or difficulties are declared in the preparation of the alloy, because of a non-uniform distribution of Bi, e.g., as described in U.S. Pat. No. 4,471,032.

Thus, it is seen that no method has been disclosed for producing aluminum-bismuth alloys with fine, homogeneous Bi dispersion.

Because the two systems Al—Pb and Al—Bi are very similar to each other, the methods used for producing aluminum-lead may also be used for producing aluminum-bismuth.

One method which has been proposed for the continuous casting of a homogeneous alloy consisting of immiscible metals is described in U.S. Pat. No. 5,333,672. The method of said Patent comprises cooling and solidification of the alloy under crossed electric and magnetic fields and modifying the gravitation force acting on the alloy components. The method determines the values of intensity of the electric and magnetic fields which provide indifferent equilibrium of the alloy components. The method also takes into account the fact that sizes of dispersed inclusions depend upon the cooling rate of the melt and upon deviations in the intensities of the electric and magnetic fields. In order to obtain a mean particle size of the dispersed phase having the predetermined value, cooling was described as being carried out according to the formula:

$$V > \frac{Tcm - Tkp}{nd} \tag{1}$$

wherein:

d is average particle size, $\mu$m;

n is an empirical coefficient, equaling $3 \leqq n \leqq 30$ sec/$\mu$m;

v is the cooling rate of the melt, degrees/sec;

Tcm is the temperature of the melt at which the components are in a state of molecular solution, ° C.; and Tkp is the crystallization temperature of the melt, ° C.

Unfortunately, the range of empirical coefficient n determined in U.S. Pat. No. 5,333,672 is too wide, and therefore it does not enable a person skilled in the art to use the relationship in calculation for real systems. In addition, said patent does not take into consideration the fact that sizes of metal microstructure elements depend not only on the cooling rate, but also on the concentration of nucleating particles. The addition of nucleants into aluminum alloy melt for grain refining is a widely used method of microstructure control.

U.S. Pat. No. 5,053,286 discloses a method of dissolving lead in molten aluminum and horizontal continuous casting of the melt in a twin-roll caster at a cooling rate of more than 200° C./sec. The microstructure obtained when the alloy is cast with such a high rate of cooling, is very fine. The cast strip produced by said method contained 5% lead and demonstrated very little lead segregation towards the bottom of the cast. The maximum lead particle size was 25 microns. However, even at such a high cooling rate and low lead content, the spheres in the bottom half of the casting were 2–2.5 times larger than those in the top half.

Metallurgical structure is claimed in the patent as containing uniformly distributed lead particles no more than 25 microns in diameter. Lead content claimed in the patent is between 4% and 10% by weight. But if 5% of lead resulted in maximum particle size 25 microns, increasing lead content from 5% to 10% would cause increasing maximum particle size resulting in particles larger than 25 microns and an increase in lead gradient.

The best control of lead particles size and lead gradient may be obtained by sintering mixed powdered aluminum and powdered lead, however, high oxides content in sintered materials results in low fatigue resistance of the bearings.

SUMMARY OF THE INVENTION

In order to overcome the shortcoming of the products and methods mentioned above, there is now provided an aluminum bismuth alloy having a homogenous distribution of bismuth therein comprising at least 5 wt/wt % bismuth, wherein about 3.5 wt/wt % of said bismuth is distributed in the form of very small particles of up to 5 microns in diameter and at least 2 wt/wt % of said bismuth is distributed in the form of spherical particles of about 10 to 40 microns in diameter and said very small particles and said spherical particles are homogeneously distributed throughout the aluminum matrix.

In a preferred embodiment of the present invention of the present invention the aluminum alloy has a bismuth content of up to 15% and optionally containing at least one further component selected from silicon, tin, lead and mixtures thereof, at a total content of between about 0.5–15 wt/wt % and optionally containing further additives selected from the group consisting of Cu, Mn, Mg, Ni, Cr, Zn, Sb, and mixtures thereof, wherein the total content of said further additives is up to 3 wt/wt %.

In another aspect of the present invention there is provided a method for continuous casting of an aluminum bismuth alloy as defined herein, comprising melting components of said alloy by heating them to at least the temperature required for the formation of a single phase molten alloy solution, additional of a nucleant in a predetermined quantity, continuously introducing said molten alloy into a solidification unit, simultaneously applying to said molten alloy electric and magnetic fields of predetermined intensities and oriented to cross each other and eliminate segregation of bismuth particles in said aluminum matrix, wherein gravitational segregation of the bismuth particles therein is reduced to zero, cooling said melt to the solidification temperature, and continuously withdrawing the solidified alloy from the solidification unit, wherein said nucleant quantity is determined according to the formula:

$$N = No + C_{Bi} \cdot No \cdot (0.1 - V/1000)$$

wherein $N$ = percent concentration of nucleant necessary for refinement of both Aluminum grains and Bismuth particles;

$No$ = percent concentration of nucleant necessary for aluminum grains refinement;

$C_{Bi}$ = percent bismuth content; and $V$ = cooling rate, °C.

DESCRIPTION OF THE DRAWINGS

In the drawings:

FIG. 1 illustrates the aluminum and bismuth placed in crossed electric and magnetic fields. Two forces act on each material: gravitational force ($F^g$) and electromagnetic force ($F^e$). Since the electromagnetic force acts on every unit volume of a sample (like gravitational force), the two forces produce conditions of pseudo-supergravity, making the samples heavier with apparent density according to the following formulas:

Figure 1:
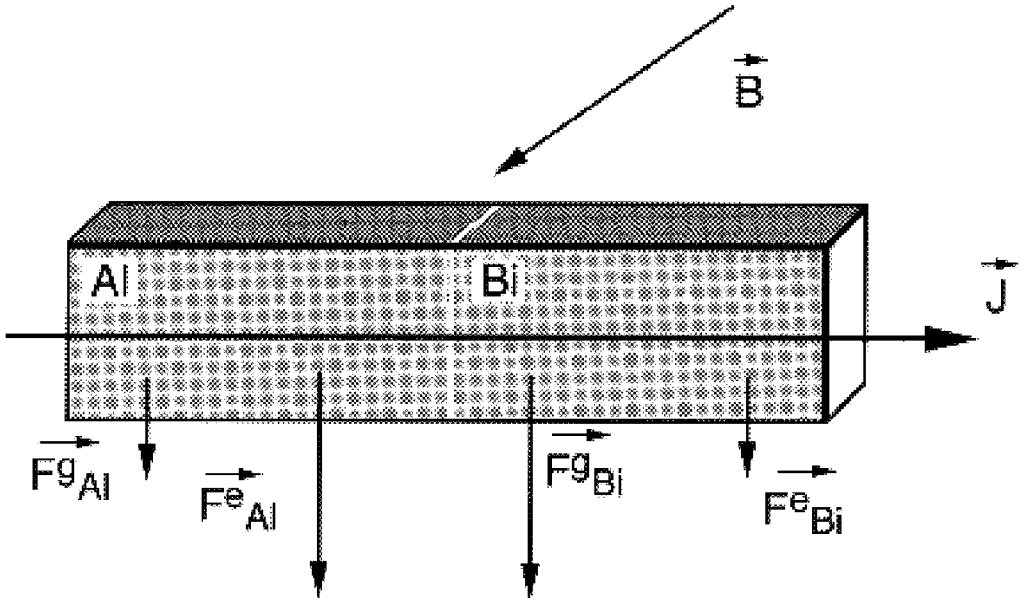
FIG. 1 Is a schematic representation of the interaction between electro-magnetic and gravitational forces, acting on aluminum and bismuth components.

$$d^1_{Al} = d_{Al} + F^e_{Al}/g \quad (2)$$

$$d^1_{Bi} = d_{Bi} + F^e_{Bi}/g$$

Wherein:

$d^1_{Al}$, $d_{Al}$, $d^1_{Bi}$, $d_{Bi}$ - apparent and real densities of aluminum and bismuth $F^e_{Al}$, $F^e_{Bi}$ - electromagnet force acting on unit volume of aluminum and bismuth $g$ - gravitational acceleration.

Gravitational segregation will be reduced to zero if $d^1_{Al} = d^1_{Bi}$. Calculations show that apparent densities of aluminum and bismuth are equal if the electric and magnetic fields are calculated according to the following formula 3:

$$j \cdot B = 7.5 \cdot 10^4 \quad (3)$$

Wherein:

| | |
|---|---|
| j | direct current density, $A/m^2$ |
| B | magnetic field intensity, T |

Cooling and solidification of the aluminum-bismuth alloy in crossed electric and magnetic fields with intensities according to formula (3) is enough for producing a structure with zero gradient of Bi, but is not sufficient for achieving the necessary distribution of bismuth particles throughout the aluminum matrix.

Dispersed particles of bismuth in aluminum should provide an optimum combination of bearing properties, such as fatigue resistance, seizure resistance, wear resistance, embedability, etc. There is a widespread opinion that small dispersed phase particles leads to good results. This statement is correct if it relates to fatigue resistance of bearings. In addition, a fine structure of the dispersed phase provides uniform and continuous supply of the soft component to the friction surface, thereby stabilizing the process.

On the other hand, very small dispersed particles (less than 5 microns) are held firmly in their matrix sockets and are not squeezed out at the moment preceding seizure in a quantity sufficient for preventing seizure. The larger a particle the easier it leaves its socket and lubricates the friction surface, preventing development of seizure. This also decreases wear caused by friction under pre-seizure conditions and reduces probability of fatigue caused by seizure. Besides this embedability of a structure with large soft phase particles is higher.

Optimal combination of these contradictory properties may be achieved by the structure having two kinds of soft inclusions: 2–3.5 wt. % of small size fraction particles (less than 5 microns) and at least 2 wt % of larger size fraction particles (10–40 microns in diameter). This bi-modal distribution of lubricating phase causes synergetic effect on bearing properties.

Figure 2:
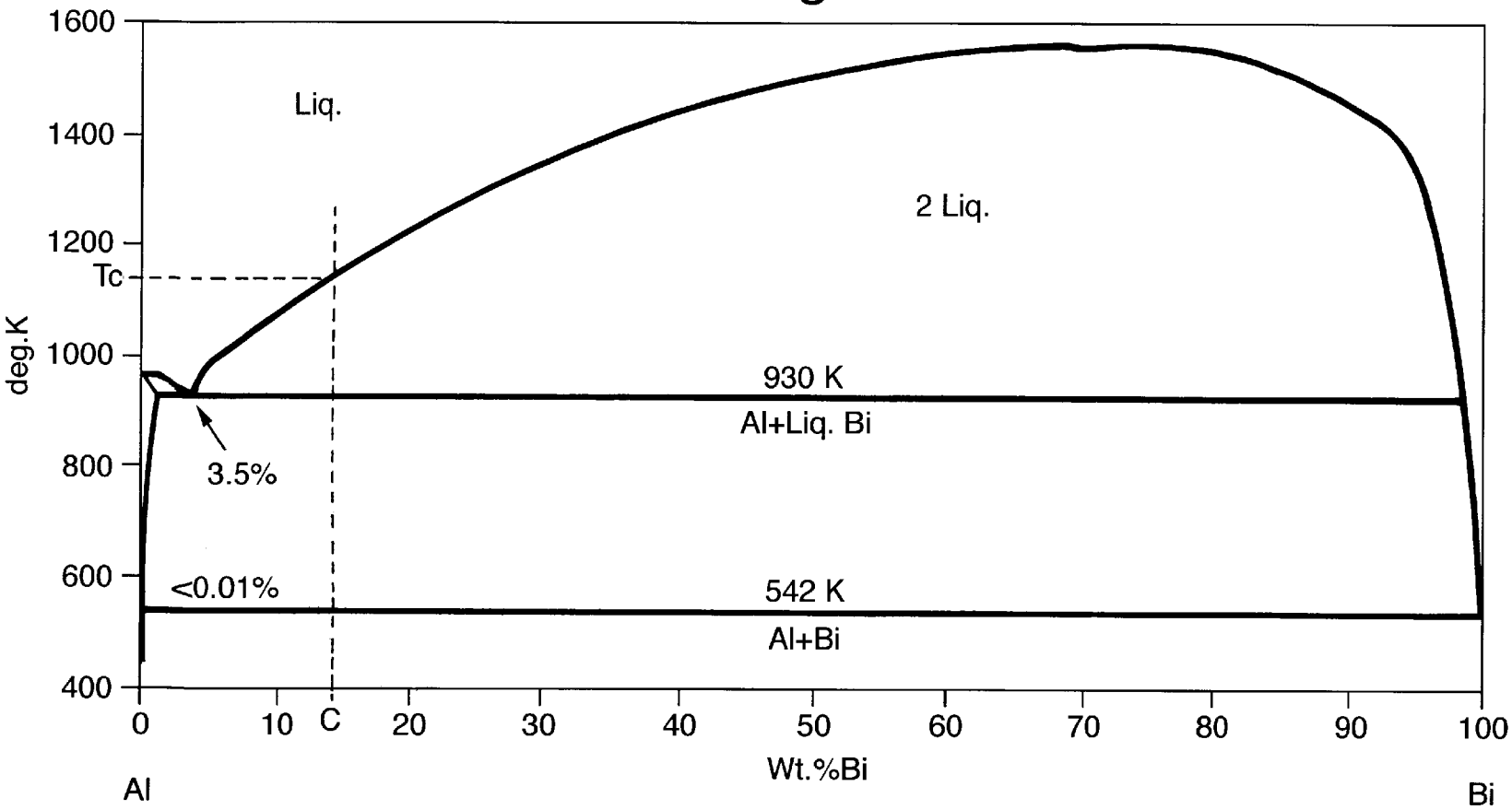
FIG. 2 Is a phase diagram of the Al—Bi system.

Analysis of the Al—Bi phase diagram appearing in FIG. 2 shows that this system is suitable for producing the above structure. The alloy containing 3.5% of Bi cools down up to a temperature of 930K (657° C.), at which temperature it undergoes a monotectic reaction, forming solid aluminum grains and liquid bismuth particles. Because the particles grow together with aluminum dendrites, their size is limited by the space between the dendritic axes, which is influenced by the cooling rate and content of nucleating additives. A composition comprising more than 3.5% of Bi (alloy C in FIG. 2) cools down to a temperature ($T_c$) where primary droplets of new phase Bi begin to form. This occurs when the alloy reaches a temperature of 930K (657° C.). Monotectic decomposition occurs at this temperature and results in the formation of secondary Bi droplets, as described above. The number of primary Bi droplets and their average size also depend on the rate of cooling and content of nucleants. Part of Bi, forming in the course of the monotectic reaction merges with the primary Bi droplets especially at low cooling rate and high Bi concentration, therefore the real content of secondary Bi is a little lower than 3.5%.

Since the sizes of primary and secondary Bi particles depend on two parameters,: namely the cooling rate and the content of nucleating additives, the same metallurgical structure of Al—Bi alloy may be produced in different continuous casting devices, providing different cooling rates. Lower rate of cooling should be compensated by increased quantity of nucleant according to formula 4:

$$N=No+C_{Bi}\cdot No\cdot(0.1-V/1000) \quad (4)$$

Wherein:

| | |
|---|---|
| N | % concentration of nucleant necessary for refinement of both Al grains and Bi particles. |
| No | % concentration of nucleant necessary for aluminum grains refinement. |
| $C_{Bi}$ | % bismuth content. |
| V | cooling rate, ° C./sec. |

While the invention will now be described in connection with certain preferred embodiments in the following examples so that aspects thereof may be more fully understood and appreciated, it is not intended to limit the invention to these particular embodiments. On the contrary, it is intended to cover all alternatives, modifications and equivalents as may be included within the scope of the invention as defined by the appended claims. Thus, the following examples which include preferred embodiments will serve to illustrate the practice of this invention, it being understood that the particulars shown are by way of example and for purposes of illustrative discussion of preferred embodiments of the present invention only and are presented in the cause of providing what is believed to be the most useful and readily understood description of formulation procedures as well as of the principles and conceptual aspects of the invention.

EXAMPLE

An alloy of the following composition was produced:

| | Bi | Sn | Si | Mn | Al |
|---|---|---|---|---|---|
| % | 8 | 1 | 4 | 0.3 | Balance |

A horizontal continuous casting machine with graphite water cooled mold was used as a basic casting equipment.

Dimensions (cross-section) of the cast strip are as follows:

Thickness—15 mm

Width—110 mm

The casting device with systems of primary and secondary water cooling was able to provide cooling rate of 30° C./sec in the center line of cast strip.

The casting machine was equipped with an electromagnet and device for passing direct current through the solidifying metal Nucleant quantity, recommended by it's manufacturer for aluminum grains refinements was 0.2%. According to formula (4), nucleant quantity, necessary for refinement of both aluminum grains and bismuth particles is 0.336%.

The process of the alloy preparation included the following steps: (1) melting and mixing of the alloy components in induction furnace and heating the melt up to 800° C. which is 50–60° C. higher than the miscibility temperature of Al-8%Bi composition (FIG. 2); (2) Addition of 0.336% of nucleant for refining metallurgical structure; (3) Pouring the melt into graphite water cooled mold; and (4) Withdrawing the cast strip from the mold. During the process solidifying metal was in the magnetic field 0.31 T, produced by electromagnet and direct electric current passed through the melt. Current value was 400A (current density is $2.42\times10^5$ $A/m^2$). Values of magnetic field intensity and direct current density were based on formula 3 as described herebefore.

Figure 3:
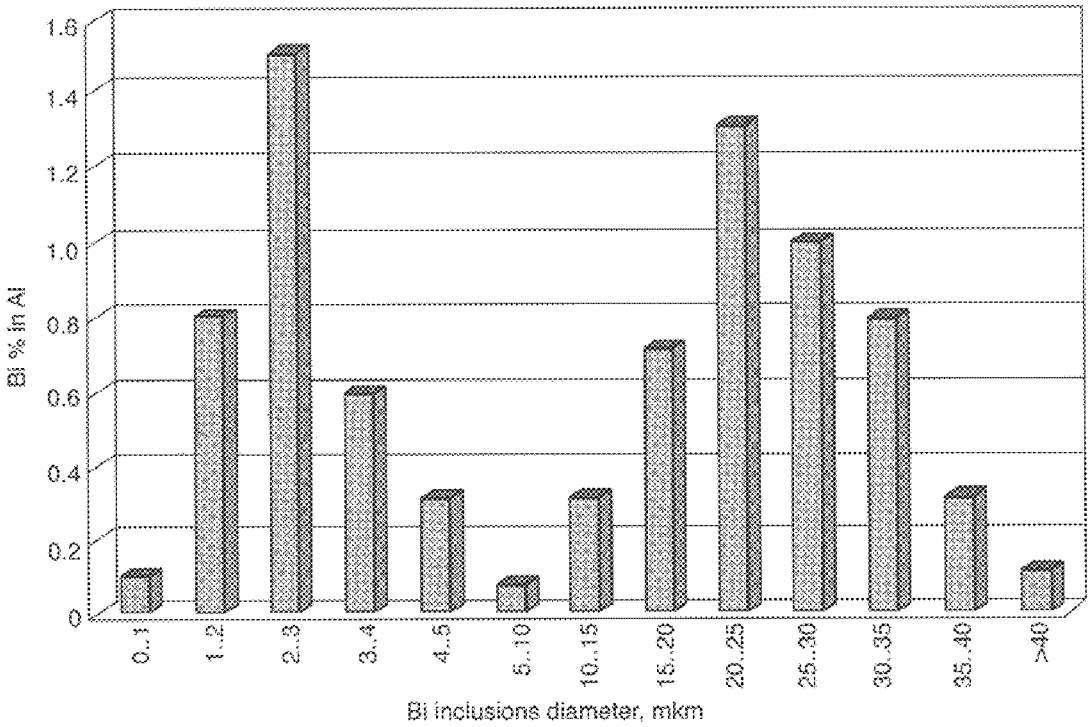
FIG. 3 Is a graphical representation of Bi particle size distribution in an Al-8% Bi alloy.

Metallographic investigation of the casting proved that there was no difference in Bi content and Bi particles size between bottom and top regions. Distribution of Bi particles sizes is presented in FIG. 3. The histogram, having two peaks at 2–3 mkm and at 20–25 mkm, demonstrates two kinds of bismuth inclusions, formed during solidification of the alloy.

Figure 4:
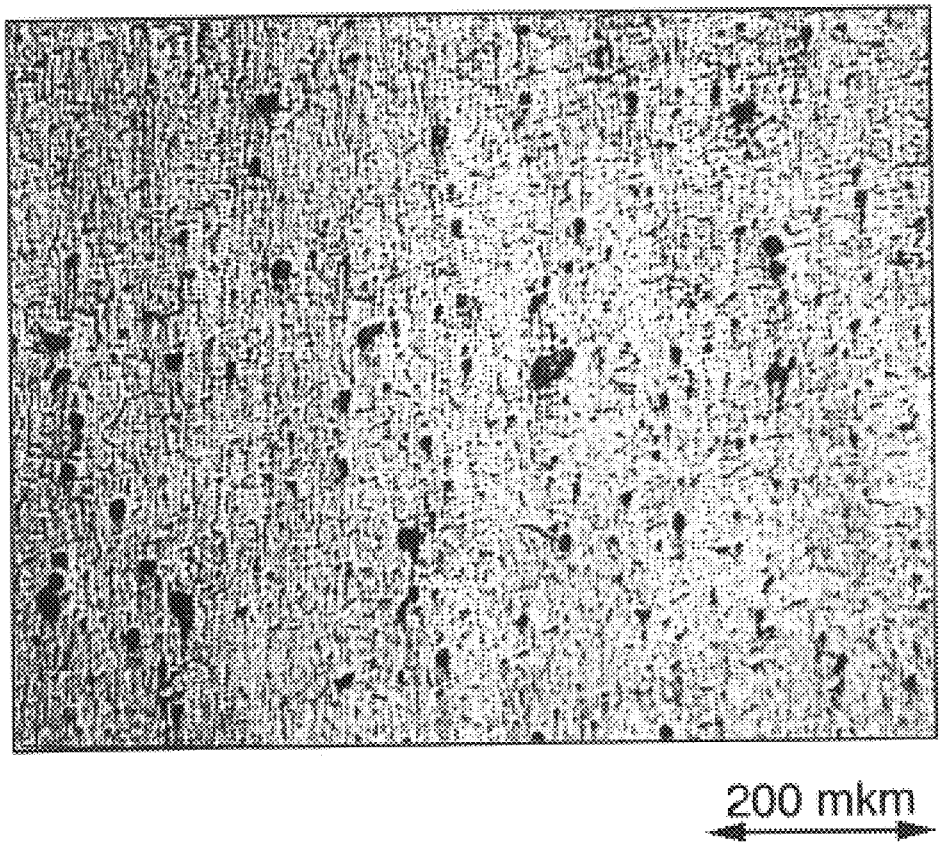
FIG. 4 Is a photographic representation of the microstructure of an Al-8% Bi alloy.

Total quantity of Bi in particles sized 5 mkm and less is 3.3%. Content of bismuth in particles of 10–40 mkm diameter is 4.4%. Small bismuth quantity (approximately 0.1%) is in inclusions of 5–10 mkm. The microstructure is shown in FIG. 4.

Obviously the method can be carried out in different casting equipment with a wide range of cooling rate.

In order to improve engine bearing quality, a number of other constituents may be added to the alloy. For example: tin and lead increase seizure resistance, silicon decreases surface roughness of nodular cast iron crankshafts and improves fatigue strength of bearings, Cu, Mn, Mg, Ni and other elements strengthens the aluminum matrix.

It will be evident to those skilled in the art that the invention is not limited to the details of the foregoing illustrative embodiments and illustrative figures and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An aluminum alloy having a homogenous distribution of bismuth therein comprising at least 5 wt % bismuth, wherein about 3.5 wt % of said alloy comprises bismuth distributed in the form of very small particles of up to 5 microns diameter and at least 2 wt % of said alloy comprises bismuth distributed in the form of spherical particles of about 10 to 40 microns in diameter and said very small particles and said spherical particles are homogeneously distributed throughout the aluminum matrix.

2. An aluminum alloy according to claim 1, having a bismuth content of up to 15% and optionally containing at least one further component selected from the group consisting of silicon, tin, lead, and mixtures thereof, at a total content of between about 0.5 to 15 wt % and optionally containing further additives selected from the group consisting of Cu, Mn, Mg, Ni, Cr, Zn, Sb, and mixtures thereof, wherein the total content of said further additives is up to 3 wt %.

3. A slide bearing comprising the aluminum alloy of claim 1.

* * * * *